US007122764B1

(12) United States Patent
Bauer et al.

(10) Patent No.: US 7,122,764 B1
(45) Date of Patent: Oct. 17, 2006

(54) SHEATHED ELEMENT GLOW PLUG

(75) Inventors: Hans-Peter Bauer, Ditzingen (DE); Albrecht Geissinger, Muehlacher (DE); Johannes Locher, Seoul (KR); Werner Teschner, Stuttgart (DE); Jochen Neumeister, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 321 days.

(21) Appl. No.: 10/088,551

(22) PCT Filed: Aug. 12, 2000

(86) PCT No.: PCT/DE00/02730

§ 371 (c)(1),
(2), (4) Date: Jul. 25, 2002

(87) PCT Pub. No.: WO01/20229

PCT Pub. Date: Mar. 22, 2001

(51) Int. Cl.
*F23Q 7/22* (2006.01)

(52) U.S. Cl. ..... 219/270; 123/145 A; 123/179.15; 123/179.21

(58) Field of Classification Search ..... 219/270, 219/505; 123/145 A, 179.15, 179.21; 180/54.1
See application file for complete search history.

(56) References Cited

U.S. PATENT DOCUMENTS 4,164,261 A * 8/1979 Igashira et al. ..... 180/54.1
4,363,958 A * 12/1982 Kobayashi et al. ..... 219/505
4,598,676 A * 7/1986 Ito et al. ..... 123/145 A
4,606,306 A * 8/1986 Caron et al. ..... 123/179.21
4,627,405 A 12/1986 Imhof et al.
4,742,209 A * 5/1988 Minegishi et al. ..... 219/270
4,934,349 A * 6/1990 Demizu ..... 123/179.21
5,039,839 A * 8/1991 Masaka et al. ..... 219/270
5,075,536 A * 12/1991 Towe et al. ..... 219/270
5,158,050 A * 10/1992 Hawkins et al. ..... 123/145 A
5,377,440 A * 1/1995 Eller et al. ..... 431/11
5,529,035 A * 6/1996 Hunt et al. ..... 123/179.15
5,922,229 A * 7/1999 Kurano ..... 219/270
6,037,568 A * 3/2000 Hatanaka et al. ..... 219/270
6,150,634 A * 11/2000 Haussner et al. ..... 219/270
6,555,788 B1 * 4/2003 Uhl ..... 219/270

FOREIGN PATENT DOCUMENTS

| | | |
|---|---|---|
| DE | 2802625 | 7/1979 |
| EP | 0657698 | 6/1995 |
| EP | 0987418 | 3/2000 |
| EP | 1001220 | 5/2000 |

* cited by examiner

*Primary Examiner*—Robin O. Evans
*Assistant Examiner*—L Fastovsky
(74) *Attorney, Agent, or Firm*—Kenyon & Kenyon

(57) ABSTRACT

A sheathed-element glow plug for self-igniting internal combustion engines has an electrical heating element which projects into a combustion chamber of the internal combustion engine, and a current feed-through for providing a heating current for the heating element through an opening in the combustion chamber. A switch is positioned in the region of the current feed-through, and the heating current may be controlled by the opening and closing of the switch.

13 Claims, 6 Drawing Sheets

SHEATHED ELEMENT GLOW PLUG

FIELD OF THE INVENTION

The present invention relates to a sheathed-element glow plug used in glow systems including a control unit and a glow plug for self-igniting combustion engines.

BACKGROUND INFORMATION

Glow plugs are known, for example, from published German Patent Application No. DE 28 02 625. Such a sheathed-element glow plug includes a tubular metallic housing which bears a thread on its outer circumference, by way of which the sheathed-element glow plug is screwed into the cylinder. At the end of the housing of the sheathed-element glow plug nearest to the combustion chamber, a glow element is enclosed by the housing and cantilevered so that it reaches towards a sheathed-element glow plug built into the engine. A heating device is arranged in the glow element which, at the combustion chamber end, makes contact with the closed bottom of the glow element to make a ground connection, and at the end away from the combustion chamber makes contact with the supply voltage via a contact stud. Ceramic glow plugs are also known, in which the part reaching into the combustion chamber is made of ceramic. In the known glow systems, the current through the heating device is switched on or off by a preheating time control unit via a switch (relay, power transistor).

SUMMARY OF THE INVENTION

The sheathed-element glow plug of this invention has the advantage that the switch for switching the glow current on and off is integrated into the housing of the sheathed-element glow plug. Since this switch switches the current of only a single plug, it can be designed to be relatively small. Being positioned near the plug thread and thus having good coupling to the cylinder head also ensures good cooling for the operation of the plug, in the case of a cold engine before the start or during the warmup phase. In the case of intermediate glow during prolonged overrun condition of the engine, the temperature at the plug threads is safely limited by the water cooling of the engine.

With this invention the cost of installation of a cable system to the sheathed-type glow plug, having large cross sections, is considerably reduced. If an integrated switching part is built into the power switch, e.g. a SMART power switch, the total number of necessary electrical leads is also reduced. A separate preheating time control unit can be completely omitted under certain circumstances, or a more compact design is made possible. If the firing control is integrated into the housing of the sheathed-type glow plug, then there is the further possibility of detecting and evaluating the glow temperature on the spot. Thereby, reaction to changes in the operating conditions can be very rapid and as good as possible. If the preheating time control device ensures regulation of the glow temperature, then one can do without the control coil of the sheathed-type glow plug, which ensures by its positive temperature coefficient of resistance that the glow temperature does not reach inadmissibly high values. A further advantage is derived from the application of semiconductor chips as switching means. By building it into the housing of the sheathed-type glow plug, the chip is sufficiently protected from outside influences so that, when the semiconductor switch is built into the sheathed-element glow plug, the customary transistor may be omitted, thus reducing costs.

DETAILED DESCRIPTION

Figure 1:
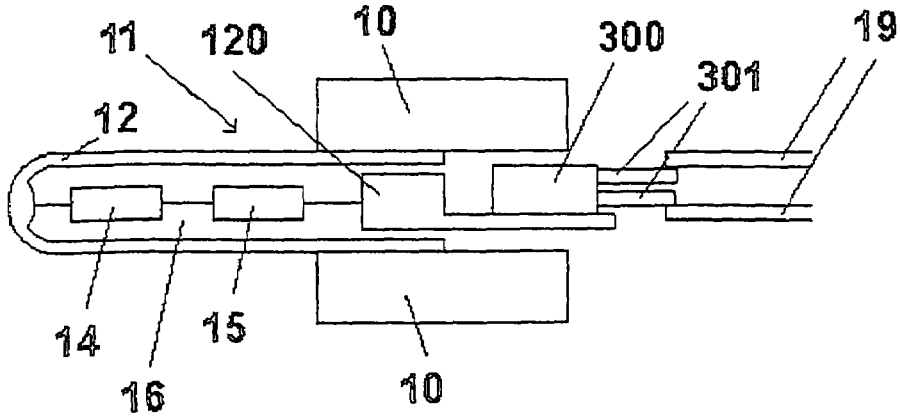
FIG. 1 shows a first exemplary embodiment of the sheathed-element glow plug according to the present invention.

FIGS. 1 through 5 each show in cross section a sheathed-element glow plug for a self-igniting internal combustion engine. The basic construction of all the exemplary embodiments in FIGS. 1 through 5 are the same, which is why the design principle is explained only once. The development of the integrated switch element, which is different in the exemplary embodiments in FIGS. 1 through 5, will be explained directly in connection with each Figure.

The design principle of a sheathed-element glow plug as in FIGS. 1 through 5 includes a tubular metallic housing, in whose longitudinal bore a glow plug 11 is inserted with part of its length in a sealing manner. Glow plug 11 is made of a hot tube 12, closed at the combustion chamber end, in which a heating device extends in the axial direction, which includes a heating coil 14 positioned at the combustion chamber end, and a regulating coil 15 positioned in a direction away from the combustion chamber. The known heating coils are here shown as resistors, for simplification. The heating device is embedded in insulating material 16, and is thus insulated from the wall of hot tube 12. The design and mode of operation of such a sheathed-element glow plug are sufficiently well known from the related art cited at the outset, and will not be explained here in greater detail. Functionally, hot tube 12, along with heating coils 14, represents a heating element projecting into the combustion chamber. Housing 10, together with insulating material 16 and regulating coil 15 represent an electrical feed-through as the supply line for electrical energy into the combustion chamber. Since we have the same basic design of the sheathed-element glow plug in FIGS. 1 through 5, the same components were given the same reference numerals.

In the sheathed-element glow plug according to the present invention as in FIG. 1, a switch element 300 is positioned in housing 10 at the end away from the combustion chamber. In switch element 300 a switch is provided by which current flow through heating device can be switched on and off. Switching element 300 is connected to supply or connecting lines 19 via plug contacts 301, via which a supply voltage and signals from a control unit, not shown here, are fed in. In this connection, the important thing is for a suitable temperature to prevail inside housing 10, for the use of semiconductor circuits. This comes about because the housing represents a current lead-through, through the wall of a cylinder of an internal combustion engine, and such cylinders are generally water-cooled. Since the housing is in direct contact with the wall of the cylinder, housing 10 and the inside of the housing are also cooled. Thus, semiconductor circuits can be used near or in the inner space of the housing for the switches according to the present invention.

The contacting of regulating coil 15 on the side away from the combustion chamber is done by a metallic connecting element 120. In FIG. 1, only one such metallic connecting element 120 is shown, which has a flattened portion at the end of the plug away from the combustion chamber, i.e. towards connecting lines 19. On this flattened area switching element 300 is positioned, which is connected to the flattened side of connecting element 120, using, for instance, solder or a conductive adhesive. In the example according to FIG. 1, switching element 300 is made up of a transistor which has a metallic drain terminal on its lower side and two terminal tags 301, which are connected to the source and the transistor gate. Apart from using a straight transistor, one may naturally also use every combination of semiconductor switch (transistor) having an "intelligent" circuit. The advantage of a packaged component is that these packaged components are especially easy to handle during the production of glow plugs.

Figure 2:
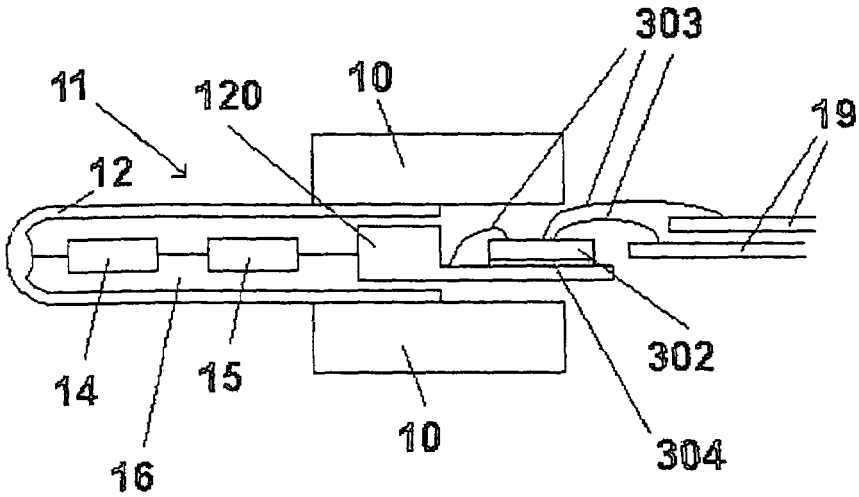
FIG. 2 shows a second exemplary embodiment of the sheathed-element glow plug according to the present invention.

FIG. 2 shows a second exemplary embodiment, in which the switching element is designed as an unencapsulated silicon chip 302. Silicon chip 302 is positioned on an insulating layer 304, so that the lower side of the silicon chip is electrically insulated from the flattened area of connecting element 120. The connection to connecting lines 19 is made by bonding wires 303. An electrical connection to connecting element 120 is also made by bonding wires 303 from the upper side of silicon chip 302. It is advantageous here that unencapsulated silicon elements as a rule are cheaper than packaged components, use less space, and the fact that the housing of the glow plug itself represents sufficient packaging for silicon chip 302.

Figure 3:
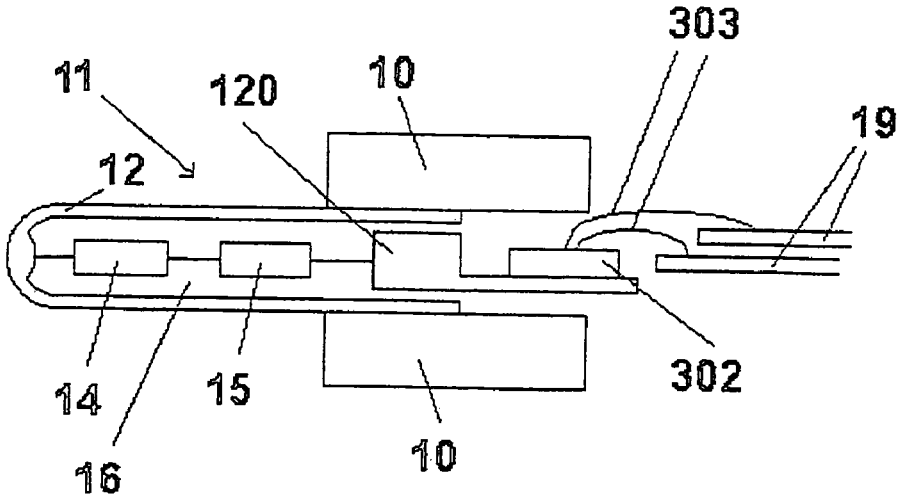
FIG. 3 shows a third exemplary embodiment of the sheathed-element glow plug according to the present invention.

FIG. 3 shows another exemplary embodiment of the glow plug according to the present invention. Here, connecting element 120 is designed as was described in connection with FIG. 1, having a round part for contacting regulating coil 15, and having a part flattened towards the back on which, according to FIG. 3, a semiconductor chip 302 without housing is positioned. Contacting the contact lines 19 takes place here again by using bonding wires 303 fastened to the upper side of semiconductor chip 302, and thus creating a connection to contact lines 19. The electrical contact to metallic connecting element 120 takes place simply in that semiconductor chip 302 which is positioned with its back side directly on the area of metallic connecting element 120 which is flattened towards the back. Semiconductor chip 302 includes a power transistor whose drain connection is formed by the back side of semiconductor chip 302.

Figure 4:
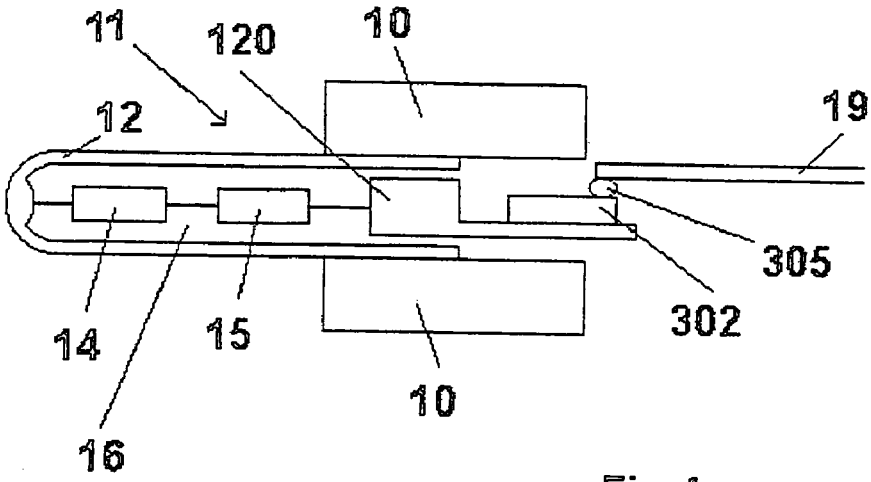
FIG. 4 shows a fourth exemplary embodiment of the sheathed-element glow plug according to the present invention.

The example as in FIG. 4 differs from the one in FIG. 3 only in that the last piece of contact lines 19 is designed in such a way that they can be fastened directly to the surface of chip 302. This can be done, for example, by having the last piece of contact lines 19 developed as thin sheet metal pieces which can be soldered directly to the surface of semiconductor chip 302 via appropriate soldering points 305.

Figure 5:
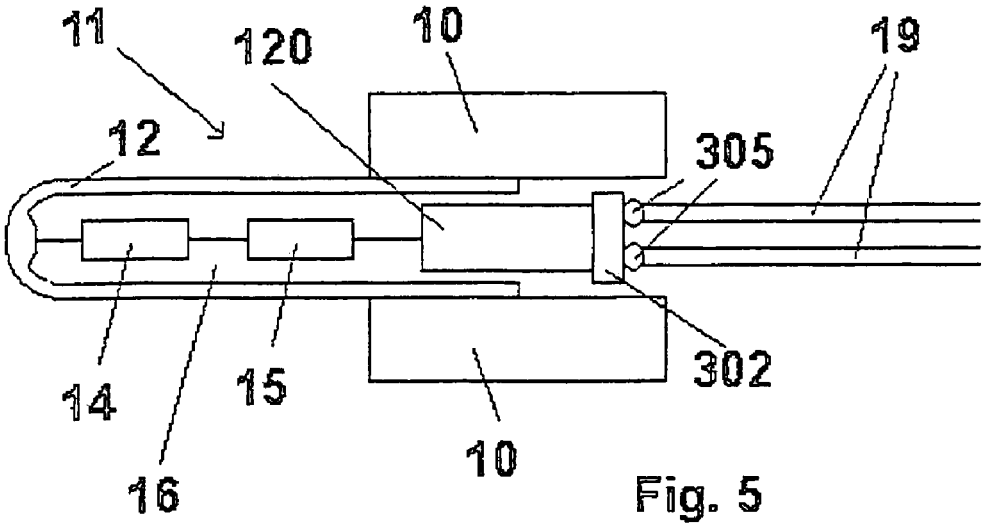
FIG. 5 shows a fifth exemplary embodiment of the sheathed-element glow plug according to the present invention.

In FIG. 5, a connecting element 120 is used which is completely rotationally symmetrical and has a completely flattened side on the side opposite the combustion chamber. On this flattened side, semiconductor chip 302 is mounted, so that once again an electrical contact is established between the lower side of semiconductor chip 302 and connecting element 120. On the upper side of semiconductor chip 302 soldering globules 305 are again provided, for contacting connecting lines 19.

Figure 6:
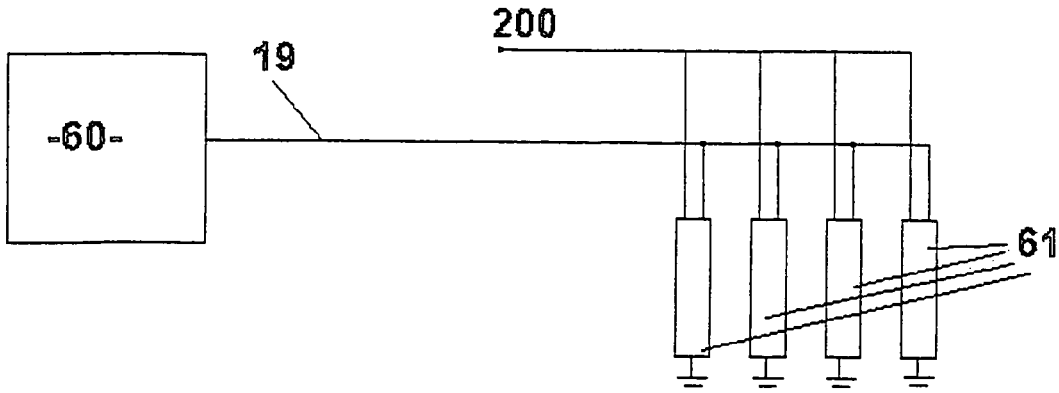
FIGS. 6 & 8 show an arrangement of a glow system according to the present invention, having the glow plugs according to the present invention in a block diagram.

FIG. 6 shows a block diagram of the entire glow system, including control device 60 and glow plugs 61. Control device 60 is here connected to glow plugs 61 over a common line 19. The glow plugs are also connected to supply voltage 200 via a further line 19.

Figure 7:
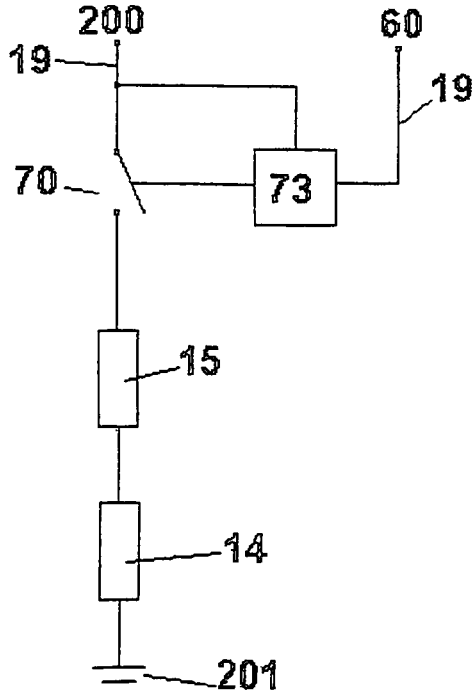
FIGS. 7 & 9 show an equivalent circuit diagrams for sheathed-element glow plug according to the present invention.

FIG. 7 shows an equivalent circuit diagram of a sheathed-element glow plug as in FIG. 6. A switch 70 is connected at one terminal to supply voltage 200, and at the other, in series, to regulating coil 15 and heating coil 14 to ground connection 201. Switch 70 is opened or closed by an activating circuit 73 via an appropriate line, activating circuit 73 receiving corresponding signals from control unit 60 via line 19. Activating circuit 73 also receives an operating current from supply terminal 200.

As can be seen in FIG. 6, all the glow plugs 61 are connected to control device 60 by a line 19. By appropriately coded bit sequences, frequency signals, etc, the glow plugs 61 can be individually activated by control device 60 in spite of this common wiring, if this is required for individual operating conditions, or for diagnostic purposes. However, in normal operation, the glow plugs as a rule are all activated in common.

The sheathed-element glow plugs described in FIGS. 1 through 7 thus have three electrical terminals, ground connection 201 being as a rule implemented by housing 10. Supply terminal 200 supplies the electrical current which delivers the electrical energy for heating via switch 70. Finally, the switching state of switch 70 is determined by a third electrical connection. Usually, customary p or n channel power MOSFETS can be used for switch 70. Activating circuit 73 and switch 70 are integrated on one semiconductor chip.

Connecting line 19 between control unit 60 and sheathed-element glow plugs 61 can also be used for the return of data from glow plugs 61 to control device 60. Control circuit 73 must then be furnished with correspondingly more intelligence, i.e. it must be in a position to transmit back certain data from the individual sheathed-element glow plugs to control unit 60. This function can also be activated, for example, for diagnostic purposes only, meaning that in a particular operating state, an individual interrogation of individual sheathed-element glow plugs 61 is performed, regarding the functions detected by them.

Figure 8:
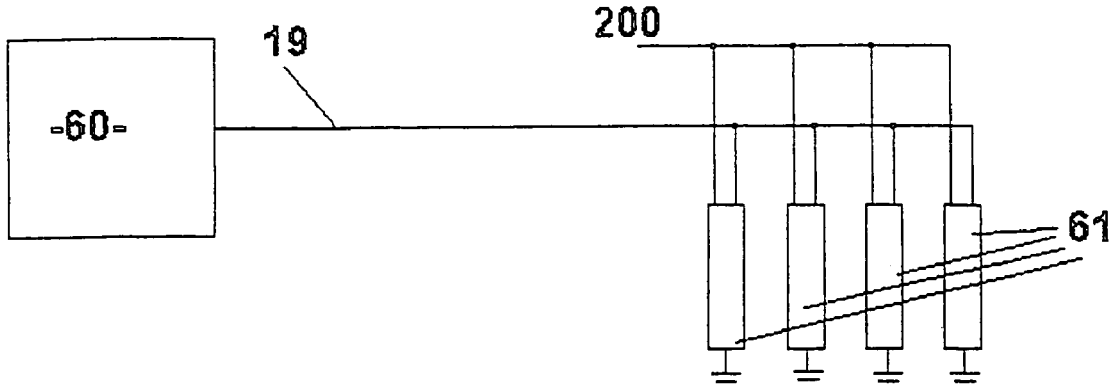

In FIG. 8 a further interconnection of a control unit 60 with sheathed-element glow plugs 61 is shown. In this case, sheathed-element glow plugs 61 only have a single connection for connecting to control unit 60 via line 19. Control unit 60 makes available the necessary operating energy for operating glow plugs 61 via line 19. The control signal for the circuit is additionally modulated upon line 19. In this case, both switch 70 and evaluation circuit 73 are connected to one connecting line. With this embodiment, on line 19 there is always a voltage level which is sufficient for operating sheathed-element glow plugs 61. The control circuit 73 recognizes from additional voltage impulses that switch 70 can now be operated. This can be done using bit sequences of frequency signals which are then recognized by control circuit 73. A simple example can be that a higher-frequency signal is simply superimposed on the usual voltage level, which is then recognized by control circuit 73 and leads to the closing of switch 70.

Figure 9:
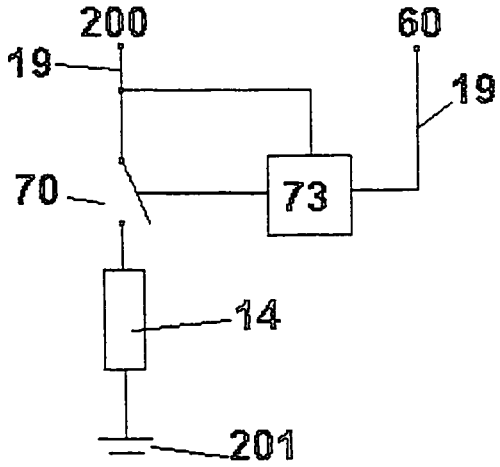

FIG. 9 shows a further advantageous circuit example, which starts from a terminal 200 for the operating voltage and a line 19 for the control signals of control unit 60. Switch element 73 here receives the control signals from control unit 60 and a supply voltage from terminal 200. Switch 70 is here positioned in series with voltage supply 200, heating coil 14 and ground terminal 201. However, in contrast to the examples up to now, one does without the use of a regulating coil 15, and only a heating coil 14 is provided. The function of regulating coil 15 is to limit the current flow through heating coil 14 after a certain warmup period. This is done by selecting a material for the regulating coil 15 whose resistance increases with increasing temperature. Because of the direct positioning of an intelligent control circuit 73 in the direct vicinity of the actual heating element, the function of the regulating coil 15 can be taken over by control circuit 73. In this connection, a temperature measuring element can then be arranged on the semiconductor chip which measures the temperature of the sheathed-element glow plug. The temperature of the sheathed-element glow plug at the location of the semiconductor chip depends on the temperature at the tip of the glow plug, so that one can determine the temperature at the tip of the glow plug from the temperature measured at the semiconductor chip. Other possibilities for determining the temperature of the sheathed-element glow plug are measuring the temperature of the heating element. The temperature of the heating element can be measured if the heating resistance has a temperature dependence on the resistance. The temperature of the glow plug 61 can then be determined by measuring the resistance of the heating element. Furthermore, other temperature-sensitive measuring elements can also be provided which can be positioned near the heating element. The control circuit 73 is then designed so that it limits current flow through heating coil 14 as a function of the measured temperature. This can be done, for instance, by pulse modulation, i.e., as a function of the temperature variation, control circuit 73 opens or closes switch 70 so as to set a desired temperature in heating coil 14. Using this measure would decisively simplify the design of the glow plug 61. Instead of using temperature measurement, the temperature of the glow plugs 61 can also be indirectly determined from current flow through the heating coil 14, current flow through the heating coil 14 integrated over time, resistance of the heating coil 14 or other methods. Thus, these methods are technically equivalent.

Figure 10:
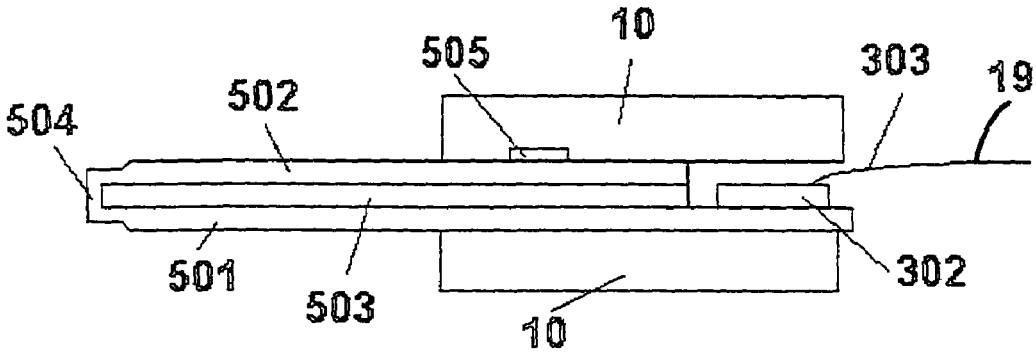
FIG. 10 shows a sixth exemplary embodiment of the sheathed-element glow plug according to the present invention.

In FIG. 10, a further embodiment of the sheathed-element glow plug according to the present invention. FIG. 10 shows a ceramic sheathed-element glow plug. In such a ceramic sheathed-element glow plug, hot tube 12 is made up of a first and a second conductive ceramic layer 501, 502, between which an insulating ceramic layer 503 is arranged. At the tip of hot tube 12, the first and the second conductive ceramic layers 501, 502 are connected to each other in a thinned-down tip region 504, so that current flow is possible from ceramic conductive layer 501 to second conductive ceramic layer 502 via thinned-down tip region 504. Hot tube 12, in turn, is held by a housing 10, at the end opposite the combustion chamber. As can be recognized in FIG. 10, first ceramic conductive layer 501 extends further to the right in housing 10, and a chip 302 is then applied to this area, which is connected to a supply line 19 by a bonding wire 303. In chip 302, in turn, a vertical transistor is arranged, which makes possible a current flow from the upper side of chip 302 to the lower side of chip 302, so that an electrical current can be fed to first conductive layer 501 via chip 302. The ceramic layers are here entirely coated with a thin superficial glass layer, which is only removed in the area under silicon chip 302 and in contact area 505, where electrical contact is established between the second conductive ceramic layer 502 and housing 110. On account of the technologies used for producing ceramic sheathed-element glow plugs, these plugs are particularly suitable for accommodating silicon chips.

What is claimed is:

1. A sheathed-element glow plug for a self-igniting internal combustion engine, comprising:

a heating element projecting into a combustion chamber of the internal combustion engine;

a current feed-through via which a heating current for the heating element is fed through an opening in the combustion chamber; and a switch positioned in the region of the current feed-through, wherein the heating current is adapted to be controlled by opening and closing the switch, wherein:

the heating element is one of a metallic and ceramic glow element;

the glow element is adapted to be fastened in the opening of the combustion chamber by use of a housing, and wherein the housing is also adapted to house the switch and the control unit; and the switch and the control circuit are integrated on one chip.

2. The sheathed-element glow plug as recited in claim 1, wherein a control circuit for the switch is positioned in the region of the current feed-through, and wherein the control circuit produces a signal for opening and closing the switch.

3. The sheathed-element glow plug as recited in claim 2, further comprising a first feed line adapted to be connected to a terminal for a supply voltage for the heating current, and a second feed line connected to the control circuit for transmitting a control signal to the control circuit.

4. The sheathed-element glow plug as recited in claim 2, further comprising an input for a line, wherein the input is connected to the switch and the control circuit, and wherein an operating voltage and a control signal for the control circuit are adapted to be simultaneously applied via the input.

5. The sheathed-element glow plug as recited in claim 2, wherein the control circuit includes a means for determining the temperature of the heating element, and wherein the heating current is controlled as a function of a signal from said means.

6. The sheathed-element glow plug as recited in claim 1, wherein the chip is applied in the housing without packaging.

7. The sheathed-element glow plug as recited in claim 1, further comprising: a housing, the heating element connectible to a ground potential of the housing.

8. The sheathed-element glow plug as recited in claim 1, further comprising a regulator configured to adjust the heating current.

9. The sheathed-element glow plug as recited in claim 1, wherein the switch includes a transistor.

10. The sheathed-element glow plug as recited in claim 1, wherein the switch includes a chip connectible via one of at least one soldering element and at least one wire to at least one feed line.

11. The sheathed-element glow plug as recited in claim 3, wherein the first feed line is adapted to be connected to the terminal in a direction facing away from the combustion chamber.

12. The sheathed-element glow plug as recited in claim 1, wherein the housing includes a raised helical rib for a screwing, the glow element adapted to be fastened in the opening of the combustion chamber via the screwing.

13. A sheathed-element glow plug for a self-igniting internal combustion engine, comprising:

a heating element projecting into a combustion chamber of the internal combustion engine;

a current feed-through via which a heating current for the heating element is fed through an opening in the combustion chamber; and a switch positioned in the region of the current feed-through wherein the heating current is adapted to be controlled by opening and closing the switch wherein the switch includes a semiconductor chip.

* * * * *